US010240315B2

(12) United States Patent
Peterfreund et al.

(10) Patent No.: US 10,240,315 B2
(45) Date of Patent: Mar. 26, 2019

(54) TIEBACK ANCHOR ALIGNMENT AND ACCESS DEVICE

(71) Applicant: McMillen Jacobs Associates, Inc., Seattle, WA (US)

(72) Inventors: Sean William Peterfreund, Seattle, WA (US); Grant Cameron Finn, Seattle, WA (US)

(73) Assignee: MCMILLEN JACOBS ASSOCIATES, INC., Seattle, WA (US)

( * ) Notice: Subject to any disclaimer, the term of this patent is extended or adjusted under 35 U.S.C. 154(b) by 42 days.

(21) Appl. No.: 15/402,895

(22) Filed: Jan. 10, 2017

(65) Prior Publication Data

US 2017/0218592 A1 Aug. 3, 2017

Related U.S. Application Data

(60) Provisional application No. 62/288,973, filed on Jan. 29, 2016.

(51) Int. Cl.
*E02D 5/76* (2006.01)
*E02D 29/02* (2006.01)

(52) U.S. Cl.
CPC ..... *E02D 5/76* (2013.01); *E02D 29/0233* (2013.01); *E02D 2220/00* (2013.01); *E02D 2600/30* (2013.01)

(58) Field of Classification Search
CPC ..... E02D 5/76; E02D 29/0233; E02D 17/04; E02D 17/08; E02D 2220/00; E02D 2600/30; E02D 5/74; E02D 5/54
USPC ..... 405/262, 284, 276, 277, 286, 287, 302.4
See application file for complete search history.

(56) References Cited

U.S. PATENT DOCUMENTS 3,807,182 A * 4/1974 Schnabel, Jr. ..... E02D 27/42 405/131
4,561,804 A * 12/1985 Weatherby ..... E02D 29/02 405/262
4,911,582 A * 3/1990 Peirce, Jr. ..... E02D 5/76 405/262
5,158,399 A * 10/1992 Flores ..... E02D 29/0283 405/262
5,395,185 A * 3/1995 Schnabel, Jr. ..... E02D 29/0233 405/262
5,423,635 A * 6/1995 Keller ..... E02D 5/76 405/259.5
6,893,191 B2 * 5/2005 Weyant ..... E02D 5/16 256/1

(Continued)

FOREIGN PATENT DOCUMENTS

JP 405280049 * 10/1993
JP H 05280049 * 10/1993

*Primary Examiner* — Carib A Oquendo
(74) *Attorney, Agent, or Firm* — Davis Wright Tremaine LLP; Heather M. Colburn

(57) ABSTRACT

A tieback alignment and access device has a hollow core and vertically aligned angled anchor subassemblies that provide attachment points for tieback anchors that pass laterally through the hollow core. The hollow core is configured to allow a cutting tool (e.g., a drill bit) to be inserted therein longitudinally and used to cut the tieback anchors at any time. When cast into a contiguous temporary support-of-excavation wall, the angled anchor subassemblies are set back from an outwardly facing surface of the wall resulting in a smooth surface.

11 Claims, 8 Drawing Sheets

(56) References Cited

U.S. PATENT DOCUMENTS

| | | | | |
|---|---|---|---|---|
| 2003/0194278 | A1* | 10/2003 | Sibilla | E02D 5/76<br>405/259.1 |
| 2004/0131429 | A1* | 7/2004 | Rainey | E02D 5/74<br>405/262 |
| 2006/0177279 | A1* | 8/2006 | Starke | E02D 5/80<br>405/287 |
| 2010/0322718 | A1* | 12/2010 | Kwon | E02D 5/76<br>405/262 |

* cited by examiner

TIEBACK ANCHOR ALIGNMENT AND ACCESS DEVICE

CROSS REFERENCE TO RELATED APPLICATION(S)

This application claims the benefit of U.S. Provisional Application No. 62/288,973, filed on Jan. 29, 2016, which is incorporated herein by reference in its entirety.

BACKGROUND OF THE INVENTION

Field of the Invention

The present invention is in the technical field of civil engineering and is directed generally toward methods and devices for supporting excavations.

Description of the Related Art

The boundary of an excavated space may include one or more substantially vertical sidewalls cut into the soil. One or more temporary support structures, such as contiguous temporary support-of-excavation ("SOE") walls, are typically installed to support the sidewalls cut into the soil and prevent these sidewalls from collapsing into the excavated space. Examples of contiguous temporary SOE walls include but are not limited to diaphragm walls, cutter-soil-mix slurry walls, and secant pile walls.

A contiguous temporary SOE wall is typically anchored to the soil behind the wall by tieback anchors. Tieback anchors, which are considered active restraint devices, typically include steel cable strands that extend from the wall into the soil, and are grouted into the soil behind the wall. After being grouted into the soil, the tieback anchors are tensioned to a high load using a hydraulic jack. Tieback anchors tensioned in this manner are referred to as being "active."

Unfortunately, conventional methods of attaching tieback anchors to a contiguous temporary SOE wall suffer from several shortcomings. For example, conventional methods of attaching tieback anchors to a contiguous temporary SOE wall are labor-intensive. Further, tieback anchors installed using conventional methods typically intrude into the excavated space.

A contiguous temporary SOE wall is needed only until a permanent structure (e.g., permanent concrete walls) designed to support the sidewalls of the excavated space is placed or constructed in front of the contiguous temporary SOE wall. After the permanent structure is in place, active tieback anchors are generally considered a liability. Accidentally cutting an active tieback anchor has the potential to cause bodily harm to workers, damage to the permanent structure, or damage to excavation equipment. As a result, most government authorities having jurisdiction over an excavation require that the tension in the tieback anchors be released (referred to as "de-tensioning") before project completion such that future construction activities will not accidently cut through and inadvertently de-tension one or more of the active tieback anchors.

Unfortunately, no simple means exists for de-tensioning conventional tieback anchors after the permanent structure has been placed or constructed in front of the contiguous temporary SOE wall. In order to facilitate de-tensioning of the tieback anchors, windows or voids are typically incorporated into the permanent structure at locations adjacent to the tieback anchors. These voids provide temporary access to permit removal or de-tensioning of the tieback anchors. Before commissioning the permanent structure, these voids must be filled with concrete. Filling these voids and repairing any associated waterproofing penetrations is time-consuming and expensive, and may compromise the integrity of the permanent structure.

Therefore, a need exists for new methods and devices for attaching tieback anchors to a contiguous temporary SOE wall. Methods and devices that allow active tieback anchors to be more easily de-tensioned are particularly desirable. The present application provides these and other advantages as will be apparent from the following detailed description and accompanying figures.

DETAILED DESCRIPTION OF THE INVENTION

Figure 4A:
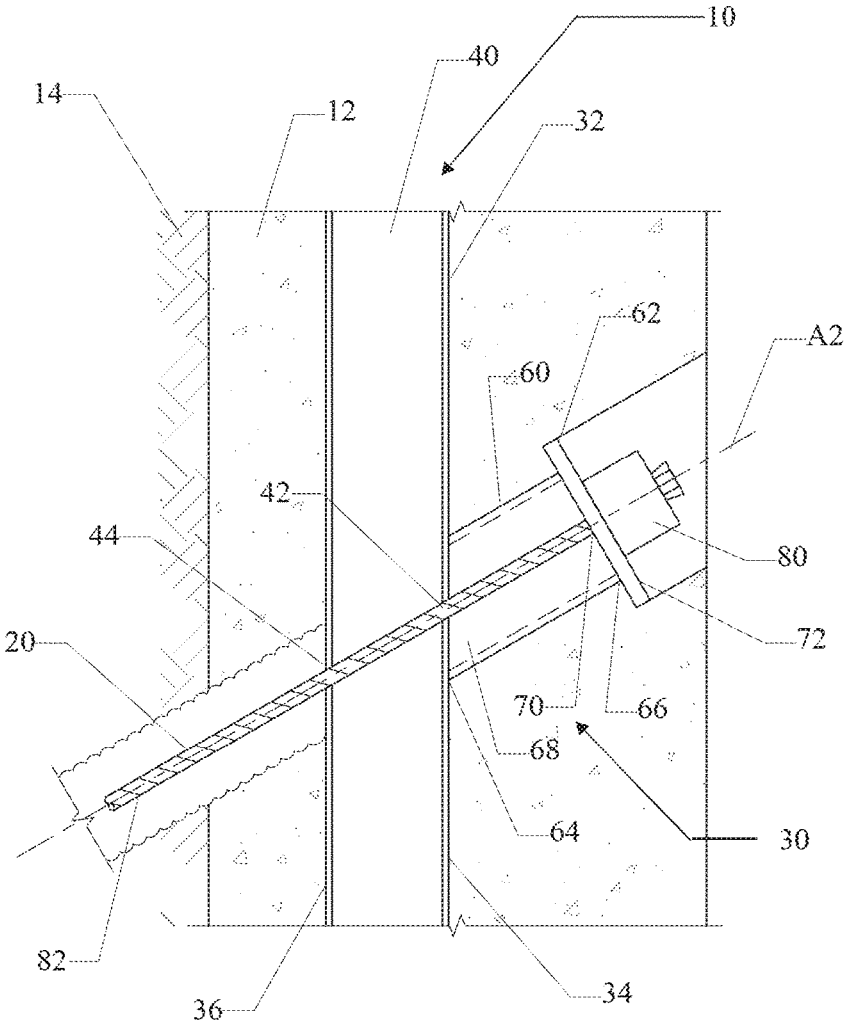
FIG. 4A is a side partial cross-sectional view of the tieback anchor alignment and access device of FIG. 1 installed in a SOE wall omitting rebar for clarity.

FIG. 4A illustrates a tieback anchor alignment and access device 10 embedded in a contiguous temporary SOE wall 12 that is supporting soil 14. The device 10 is anchored to the soil by at least one tieback anchor 20. Rebar (not shown), which would typically be included in the SOE wall 12, has been omitted from FIGS. 3A-4B.

As is apparent to those of ordinary skill in the art, any number of laterally spaced apart devices each like the device 10 may be embedded in the SOE wall 12. For example, referring to FIGS. 3B and 5B, a plurality of devices 10A-10C each substantially identical to the device 10 (see FIG. 1) may be embedded within the SOE wall 12. Further, each of the devices 10A-10C is attached to one or more tieback anchors 20 that anchor the devices 10A-10C (and the SOE wall 12 in which the devices 10A-10C are embedded) to the soil 14 (see FIG. 3B). As is apparent to those of ordinary skill in the art, any number of tieback anchors may be attached to each of the device 10A-10C and used to anchor the SOE wall 12 to the soil 14 (see FIG. 3B).

Referring to FIG. 4A, the device 10 includes a different anchor subassembly 30 attached to an upright support assembly 32 for each tieback anchor 20 attached the device 10. Referring to FIGS. 1-3A and 4A-5A, for ease of illustration, the device 10 has been illustrated as including only the single anchor subassembly 30 for attachment to the single tieback anchor 20 (see FIGS. 3A and 4A-5A). However, any number of subassemblies each like the subassembly 30 may be attached to the upright support assembly 32 and coupled to a different tieback anchor 20. For example, referring to FIG. 5B, the device 10A, which is attached to three different tieback anchors 20, includes three subassemblies 30A-30C. Similarly, the device 10B, which is attached to three different tieback anchors 20, includes three subassemblies 30D-30F, and the device 10C, which is also attached to three different tieback anchors 20, includes three subassemblies 30G-30I. The subassemblies 30A-30I are substantially identical to one another and, as shown in FIG. 5B, are each coupled to a different tieback anchor 20.

Figure 1:
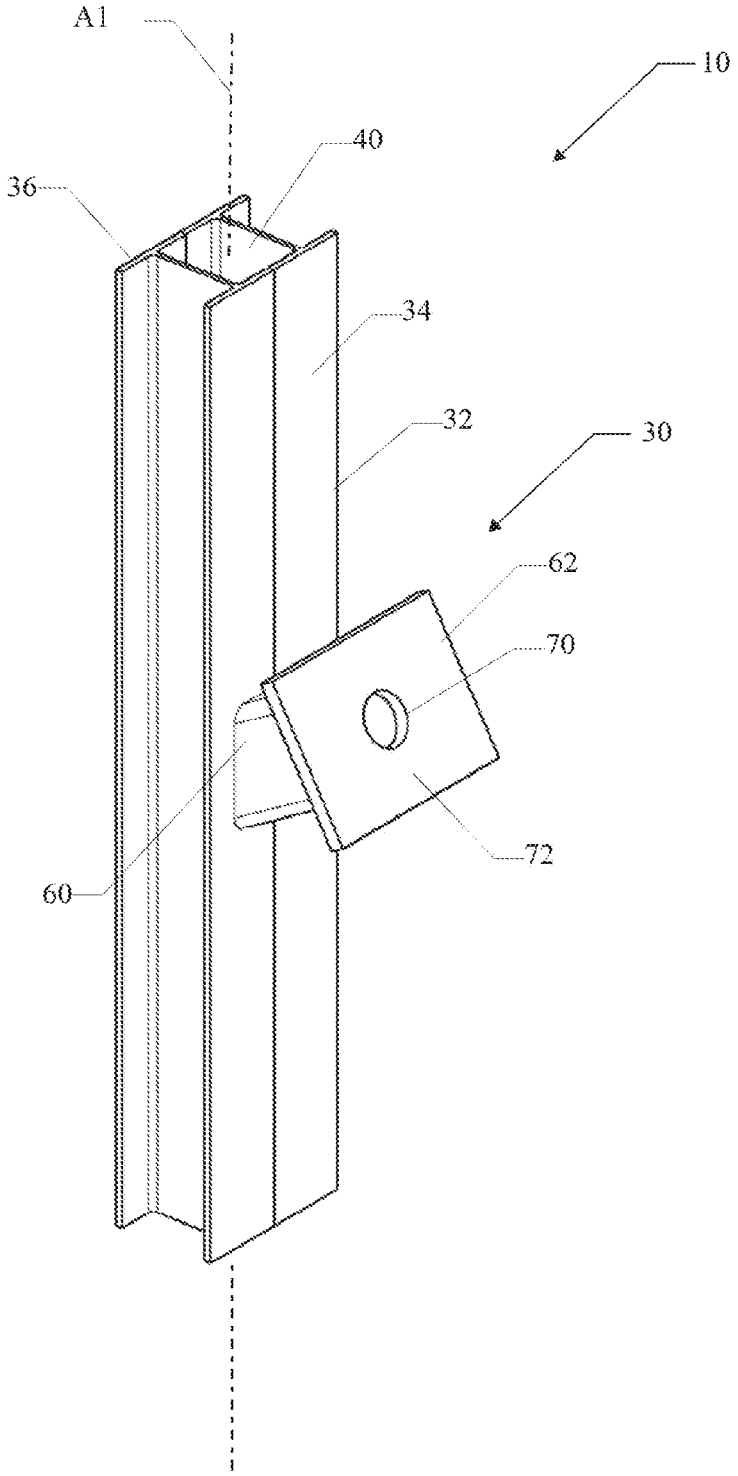
FIG. 1 is a perspective view of an embodiment of a tieback anchor alignment and access device.
Figure 5A:
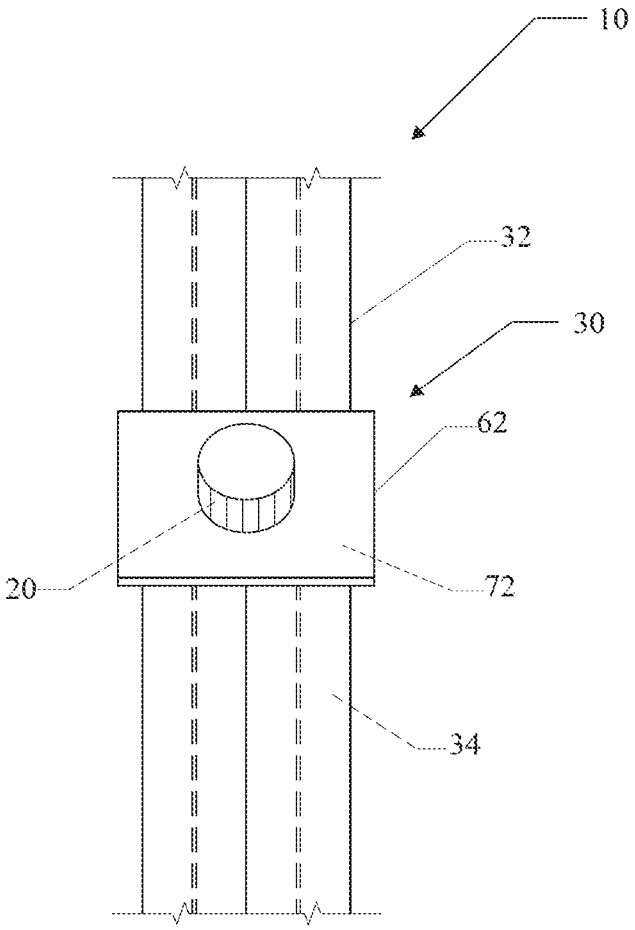
FIG. 5A is a front (elevation) view of the tieback anchor alignment and access device of FIG. 1.
Figure 5B:
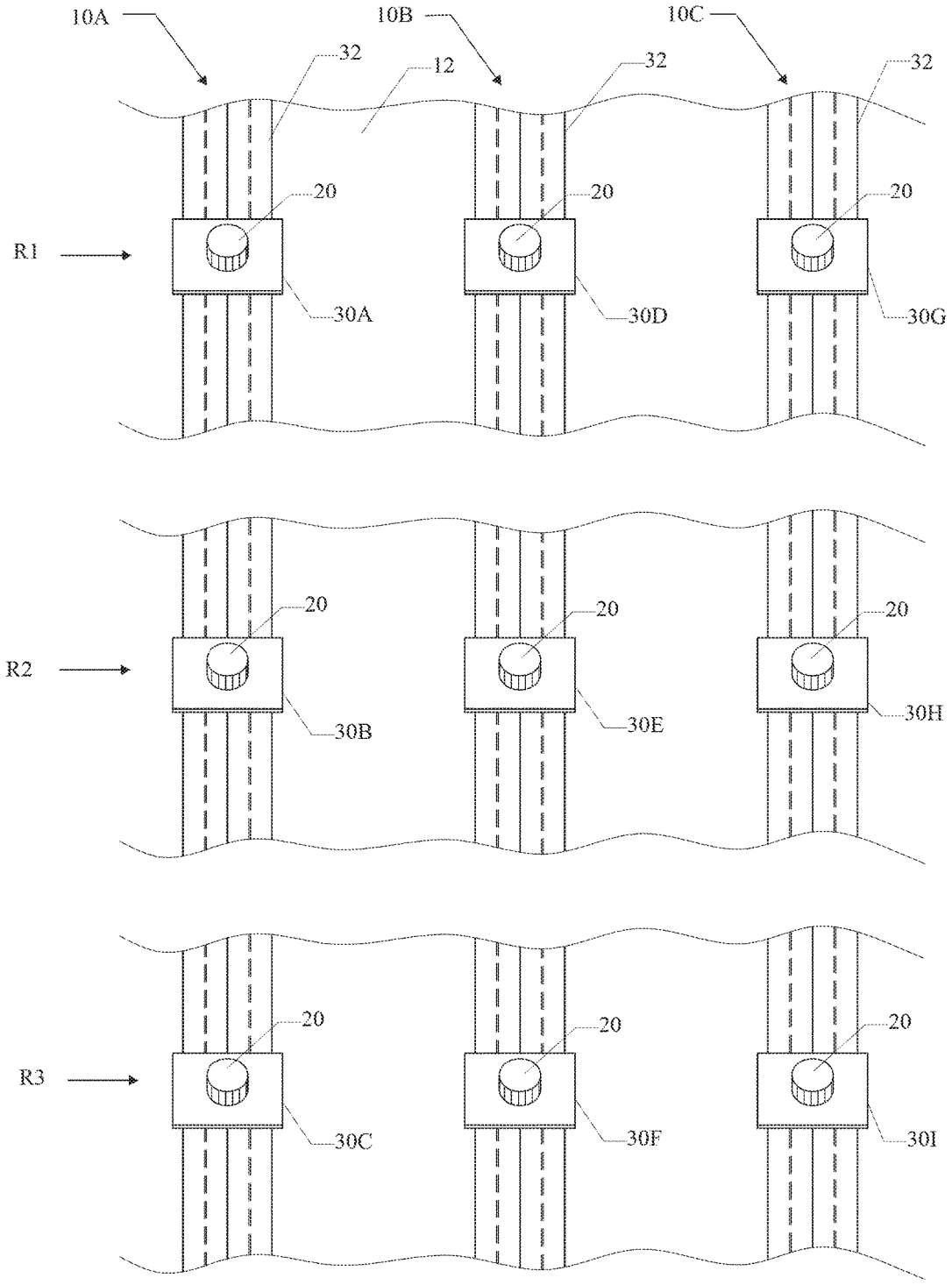
FIG. 5B is a front (elevation) view of the contiguous temporary SOE wall of FIG. 3B.

Referring to FIG. 1, the upright support assembly 32 extends along a longitudinal axis "A1." As illustrated in FIG. 5B, when the device (e.g., the device 10A) includes multiple subassemblies (e.g., the subassemblies 30A-30C), the subassemblies are attached to the upright support assembly 32 at different locations along the longitudinal axis "A1" (see FIG. 1). Further, the subassemblies 30A-30C may be aligned vertically along the longitudinal axis "A1" (see FIG. 1). If desired, the devices 10A-10C may be aligned such that the subassemblies 30A-30I are arranged in rows horizontally. For example, the subassemblies 30A, 30D, and 30G of the devices 10A-10C, respectively, may be aligned with one another horizontally to define a first horizontal row "R1." Similarly, the subassemblies 30B, 30E, and 30H of the devices 10A-10C, respectively, may be aligned with one another horizontally to define a second horizontal row "R2," and the subassemblies 30C, 30F, and 30I of the devices 10A-10C, respectively, may be aligned with one another horizontally to define a third horizontal row "R3."

Referring to FIG. 5B, together, the lateral or horizontal locations of the devices 10A-10C within the SOE wall 12, and the vertical locations of the subassemblies 30A-30I in the devices 10A-10C provide a template that specifies where (both vertically and horizontally) each of the tieback anchors 20 will be attached to the SOE wall 12. In other words, the locations of the subassemblies 30A-30I within the SOE wall 12 provide predetermined locations for the attachment of the tieback anchors 20 to the SOE wall 12. This differs significantly from prior art methods of attaching tieback anchors, which result in a high degree of variability in their positioning along a contiguous temporary SOE wall.

Referring to FIG. 1, the upright support assembly 32 has a front surface 34 opposite a back surface 36. An open-ended upright through-conduit or hollow core 40 extends through the upright support assembly 32 along the longitudinal axis "A1." Referring to FIG. 4A, the front surface 34 includes a different front through-hole 42 in communication with the hollow core 40 for each anchor subassembly 30. Similarly, the back surface 36 includes a different back through-hole 44 in communication with the hollow core 40 for each anchor subassembly 30. As shown in FIG. 4A, the front and back through-holes 42 and 44 are offset from one another along the longitudinal axis "A1" (see FIG. 1).

Figure 2:
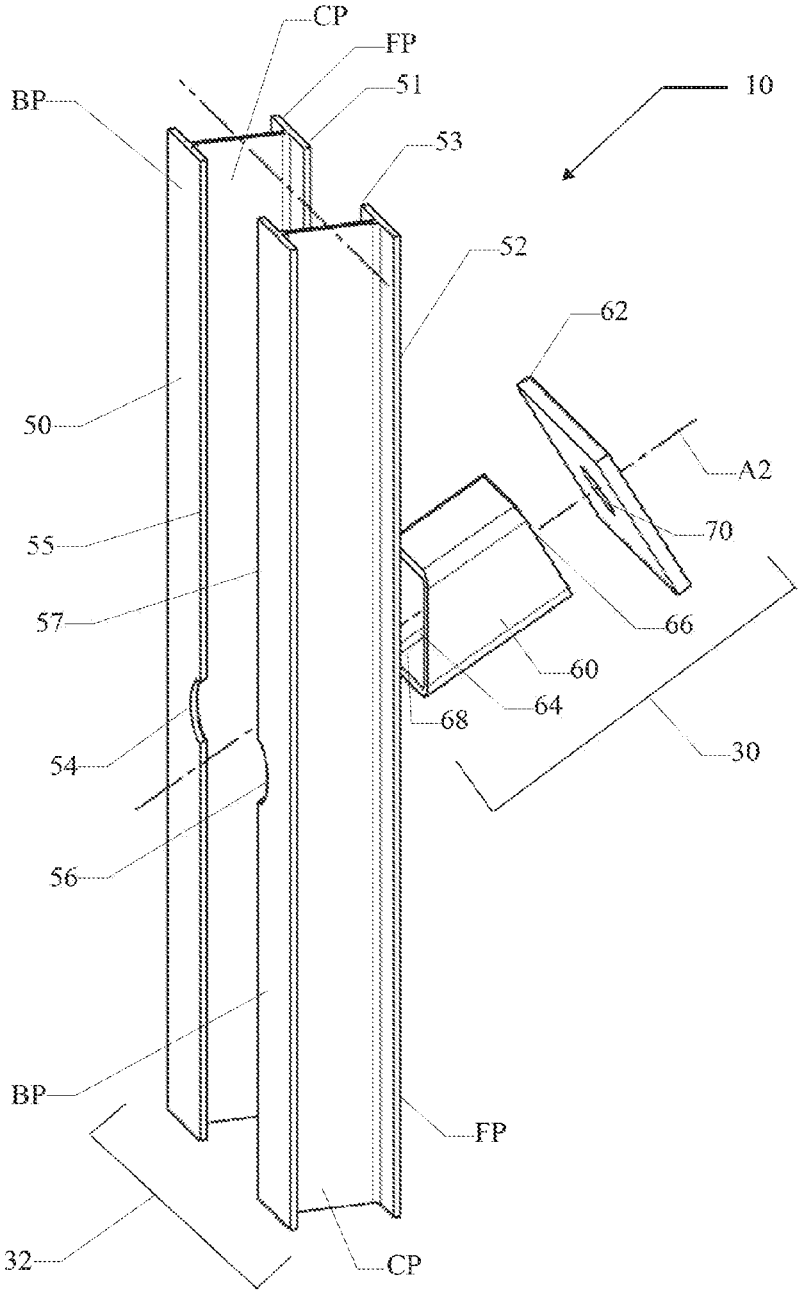
FIG. 2 is an exploded perspective view of the tieback anchor alignment and access device of FIG. 1.
Figure 3A:
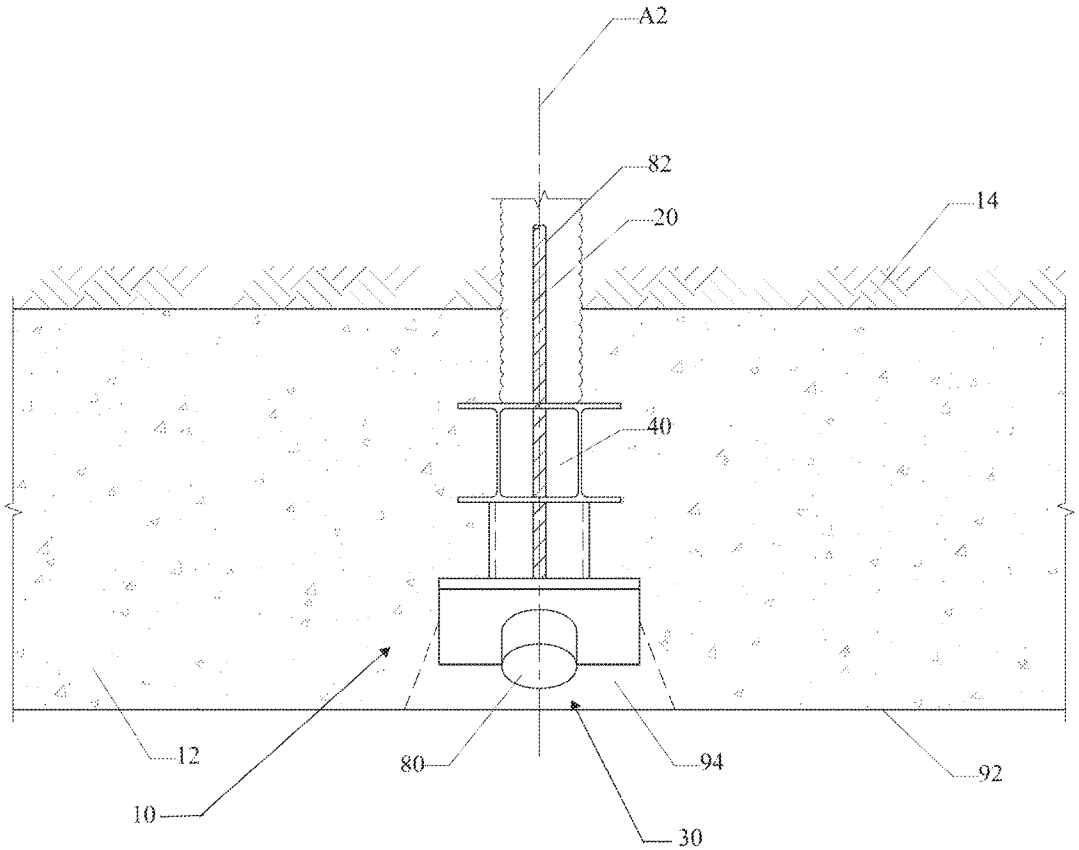
FIG. 3A is a top (plan) view of the tieback anchor alignment and access device of FIG. 1 installed in a contiguous temporary SOE wall omitting rebar for clarity.
Figure 3B:
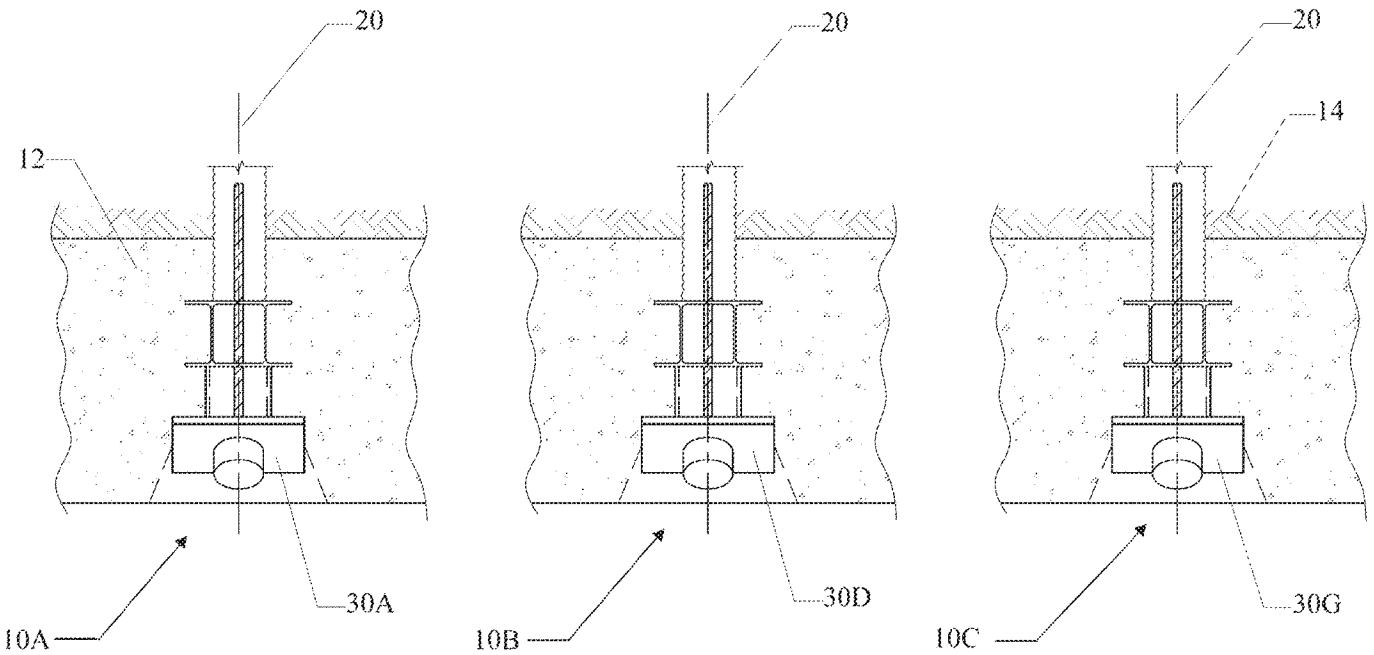
FIG. 3B is a top (plan) view of a contiguous temporary SOE wall including a plurality of the devices of FIG. 1 and omitting rebar for clarity.

Referring to FIG. 2, in the embodiment illustrated, the upright support assembly 32 includes first and second I-shaped members 50 and 52 positioned side-by-side. The first and second members 50 and 52 are substantially identical to one another and may each be implemented as a steel I-beam. Each of the first and second members 50 and 52 has a front flange or plate "FP" connected to a back flange or plate "BP" by a connecting web or plate "CP." In the upright support assembly 32, the front plate "FP" of the first member 50 is positioned alongside and aligned with the front plate "FP" of the second member 52. Adjacent edges 51 and 53 of the front plates "FP" of the first and second members 50 and 52, respectively, are welded together. Similarly, the back plate "BP" of the first member 50 is positioned alongside and aligned with the back plate "BP" of the second member 52. Adjacent edges 55 and 57 of the back plates "BP" of the first and second members 50 and 52, respectively, are welded together. Thus, referring to FIG. 1, together, frontwardly facing surfaces of the front plates "FP" form the front surface 34. Similarly, together, backwardly facing surfaces of the back plates "BP" form the back surface 36. The hollow core 40 (see FIGS. 1, 3A, 4A, and 4B) is defined between the connecting plates "CP" of the first and second members 50 and 52.

Referring to FIG. 2, edge cutouts 54 and 56 are formed in the adjacent edges 55 and 57, respectively, of the back plates "BP" for each anchor subassembly 30. The edge cutouts 54 and 56 are aligned with one another and, when the upright support assembly 32 is fully assembled, define the back through-hole 44 (see FIG. 4A). Similarly, edge cutouts (not shown) substantially identical to the edge cutouts 54 and 56 are formed in the adjacent edges 51 and 53 of the front plates "FP" for each anchor subassembly 30. The edge cutouts (not shown) formed in the adjacent edges 51 and 53 are aligned with one another and, when the upright support assembly 32 is fully assembled, define the front through-hole 42 (see FIG. 4A).

While the upright support assembly 32 is illustrated as including the first and second I-shaped members 50 and 52, this is not a requirement. In alternate embodiments, the upright support assembly 32 may be constructed from steel plates, or other shapes joined together to define the hollow core 40 (see FIGS. 1, 3A, 4A, and 4B) and provide the front and back surfaces 34 and 36 (see FIGS. 1, 4A, and 4B) having the front and back through-holes 42 and 44 (see FIG. 4A), respectively, formed therein.

Referring to FIG. 2, the subassembly 30 includes a standoff member 60 and a bearing plate 62. In the embodiment illustrated, the standoff member 60 has a generally square or rectangular cross-sectional shape. The standoff member 60 has a first end 64 opposite a second end 66 and an open-ended conduit 68 that extends from the first end 64 to the second end 66. Referring to FIG. 4A, the first end 64 of the standoff member 60 is mounted to the front surface 34 of the upright support assembly 32 with the conduit 68 aligned with the front through-hole 42. The standoff member 60 may be constructed from hollow structural steel or plates.

Referring to FIG. 1, the bearing plate 62 may be substantially planar. A through-hole 70 is formed in the bearing plate 62. Referring to FIG. 4A, the bearing plate 62 is mounted to the second end 66 of the standoff member 60 with the through-hole 70 aligned with and opening into the conduit 68. Referring to FIG. 1, the bearing plate 62 has a surface 72 that faces outwardly when the bearing plate 62 is mounted to the standoff member 60. The through-hole 70 may be at or near the center of the surface 72 of the bearing plate 62.

Referring to FIG. 4A, the tieback anchor 20 includes an anchor head 80 coupled to anchor strands 82. The through-hole 70 is configured to allow the tieback strands 82 to pass therethrough. The through-hole 70 is aligned with both the front and back through-holes 42 and 44 of the upright support assembly 32. In other words, the through-holes 42, 44, and 70 are collinear along an anchor axis "A2." The anchor strands 82 extend rearwardly from the anchor head 80 (which is positioned against the outwardly facing surface 72) and pass through the through-hole 70 into the conduit 68 of the standoff member 60. The anchor strands 82 pass through the conduit 68, exit therefrom through the front through-hole 42, and enter the hollow core 40. The anchor strands 82 extend through the hollow core 40 laterally, exit from the hollow core 40 through the back through-hole 44, and extend through a portion of the SOE wall 12 and into the soil 14. A portion of the anchor strands 82 extending into the soil 14 may be grouted into the soil 14. As shown in FIG. 4A, the anchor strands 82 extend through the device 10 along the anchor axis "A2," which is at an angle (typically between 70 and 90 degrees) with respect to the longitudinal axis "A1" (see FIG. 1).

The anchor head 80 is too large to pass through the through-hole 70 and bears against the bearing plate 62 around the through-hole 70 when the tieback anchor 20 is active. The bearing plate 62 in turn bears against the standoff member 60, which bears against the upright support assembly 32. The standoff member 60 and the bearing plate 62 are configured to resist the load applied thereto by the anchor head 80.

Figure 4B:
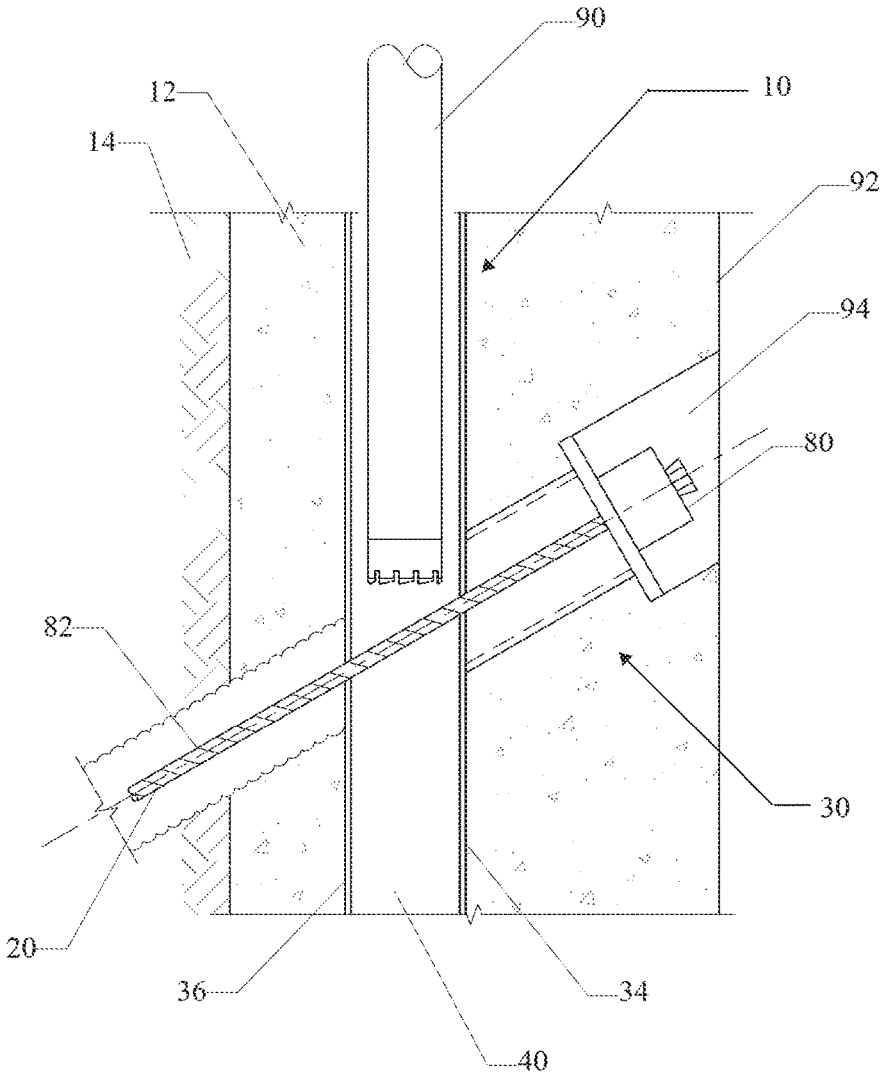
FIG. 4B is a side partial cross-sectional view of the tieback anchor alignment and access device of FIG. 1 with a cutting tool inserted into the device to de-tension a tieback anchor coupled to the device.

Referring to FIG. 4B, the hollow core 40 provides a conduit through which a cutting device 90 (e.g., a diamond rotary coring bit powered by a drill rig) may be inserted along the longitudinal axis "A1" (see FIG. 1) from above (e.g., from the ground surface) and used to sever the anchor strands 82. The conduit provided by the hollow core 40 is not so large as to allow the cutting device 90 to bypass and accidently miss the anchor strands 82. The sidewalls of the hollow core 40 may help guide the cutting device 90 through the hollow core 40. Thus, the device 10 provides access to the anchor strands 82 from the ground surface that may be used to de-tension the tieback anchor 20 thereby eliminating the need for the inclusion of passageways and voids in the permanent structure of the type used in the prior art to de-tension tieback anchors.

After the anchor strands 82 have been severed (thereby de-tension the tieback anchor 20), the hollow core 40 may remain empty or be backfilled (e.g., with soil). As shown in FIG. 4B, the device 10 may be spaced inwardly from a final outwardly facing SOE wall face 92. Optionally, the subassembly 30 may be positioned behind a front curtain of reinforcing bars (not shown). In the embodiment illustrated, each subassembly 30 is spaced inwardly from the wall face 92 and positioned within a recess 94 formed in the SOE wall 12. Thus, neither the device 10 nor the tieback anchor 20 extends beyond the wall face 92 and into the excavated space. Further, except for the recess 94, the wall face 92 is continuous and smooth. If desired, the recess 94 may be filled and finished such that the wall face 92 is continuous and smooth before or after the tieback anchor 20 has been de-tensioned. After being finished, the wall face 92 may be waterproofed, if desired.

The device 10 may provide several advantages over prior art methods of attaching tieback anchors to a contiguous temporary SOE wall. For example, the device 10 provides means for both installing and de-tensioning tieback anchors when used with contiguous SOE walls. The device 10 provides a template for organizing tieback anchor locations, where current practice results in a high degree of variability in positioning. The device 10 allows tieback anchors to be de-tensioned at any point in time after the permanent structure is in place. Further, the device 10 eliminates the need to leave voids in the permanent structure and patch the subgrade waterproofing system at the locations of those voids. Additionally, if desired, the wall face 92 may be finished smooth and flush.

The device 10 may be implemented using a vertical hollow steel assembly combined with at least one hollow steel standoff and bearing plate having the capacity to accommodate at least one tieback anchor.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

Accordingly, the invention is not limited except as by the appended claims.

The invention claimed is:

1. An assembly configured to be embedded in a contiguous support-of-excavation ("SOE") wall, the assembly being for use with a tieback anchor comprising anchor strands, the assembly comprising:

an upright support comprising first and second I-Beams extending along a longitudinal axis, the first I-Beam comprising a first front plate and a first rear plate interconnected by a first connecting plate, the first connecting plate being a first side portion of the upright support, the second I-Beam comprising a second front plate and a second rear plate interconnected by a second connecting plate, the second connecting plate being a second side portion of the upright support, a front portion of the upright support comprising the first and second front plates, a rear portion of the upright support comprising the first and second rear plates, the front portion being opposite the rear portion, the second side portion being opposite the first side portion, a through-conduit being defined between the front portion, the rear portion, the first side portion, and the second side portion, the through-conduit extending along the longitudinal axis, the through-conduit having an upper inlet accessible from above the SOE wall, the front portion having a front opening into the through-conduit and the rear portion having a rear opening into the through-conduit, a passageway extending laterally across the through-conduit, the passageway being defined between the front and rear openings, the front and rear openings being configured to allow the anchor strands to pass through the passageway, the upper inlet providing access along the longitudinal axis into the passageway and to a portion of the anchor strands extending laterally across the through-conduit within the passageway.

2. The assembly of claim 1, further comprising:

a standoff member comprising a first end opposite a second end, the first end being immediately adjacent to the upright support, an open-ended conduit extending between the first and second ends of the standoff member, the open-ended conduit being in communication with the front opening into the through-conduit, the open-ended conduit being configured to allow the anchor strands to pass therethrough into the front opening.

3. The assembly of claim 2 for use with the tieback anchor comprising an anchor head, the assembly further comprising:

a bearing plate abutting the second end of the standoff member, the bearing plate having an aperture in communication with the open-ended conduit, the aperture being configured to allow the anchor strands to pass therethrough into the open-ended conduit with the anchor head bearing against the bearing plate.

4. The assembly of claim 3, wherein the anchor strands extend through the through-conduit along an anchor axis, and the anchor axis is at an angle between 70 degrees and 90 degrees with respect to the longitudinal axis.

5. The assembly of claim 1, wherein a first portion of the front opening is formed in the first front plate and a second portion of the front opening is formed in the second front plate, and a first portion of the rear opening is formed in the first rear plate and a second portion of the rear opening is formed in the second rear plate.

6. The assembly of claim 1, wherein the through-conduit is configured to allow a cutting device therethrough to sever the portion of the anchor strands extending laterally across the through-conduit within the passageway.

7. An assembly comprising:

a contiguous support-of-excavation ("SOE") wall comprising an inside face having a recess, the SOE wall supporting soil;

a support assembly embedded in the SOE wall adjacent to the recess, the support assembly comprising an upright support, a standoff member, and a bearing plate, the upright support comprising a through-conduit that extends along a longitudinal axis, the through-conduit having an upper inlet accessible from above the SOE wall, the standoff member being configured to be positioned inside the recess, the standoff member having a first end opposite a second end, the first end being immediately adjacent the upright support, an open-ended conduit extending from the second end of the standoff member and passing laterally through the through-conduit, the bearing plate abutting the second end of the standoff member and being recessed within the recess with respect to the inside face, the bearing plate having an aperture in communication with the open-ended conduit; and an anchor comprising an anchor head and anchor strands, the anchor head bearing against the bearing plate, the anchor strands extending from the anchor head through the aperture, through the open-ended conduit, and into the soil, the upper inlet providing uninterrupted access along the longitudinal axis into the open-ended conduit and to a portion of the anchor strands extending laterally through the through-conduit within the open-ended conduit.

8. The assembly of claim 7, wherein the recess is filled to enhance groundwater cutoff capabilities and allow the inside face to be finished.

9. The assembly of claim 7, wherein the recess is filled with concrete.

10. An upright support configured to be embedded in a contiguous support-of-excavation ("SOE") wall, the upright support being for use with a tieback anchor comprising anchor strands, the upright support comprising:

a first side portion extending along a longitudinal axis;

a second side portion opposite the first side portion and extending along the longitudinal axis;

a front portion extending along the longitudinal axis;

a rear portion opposite the front portion and extending along the longitudinal axis; and a through-conduit defined between the front portion, the rear portion, the first side portion, and the second side portion, the through-conduit extending along the longitudinal axis, the through-conduit having an upper inlet accessible from above the SOE wall, the front portion having a front opening into the through-conduit and the rear portion having a rear opening into the through-conduit, a passageway extending laterally across the through-conduit, the passageway being defined between the front and rear openings, the front and rear openings being configured to allow the anchor strands to pass through the passageway, the upper inlet providing access along the longitudinal axis into the passageway and to a portion of the anchor strands extending laterally across the through-conduit within the passageway.

11. The upright support of claim 10, wherein the through-conduit is configured to allow a cutting device therethrough to sever the portion of the anchor strands extending laterally across the through-conduit within the passageway.

* * * * *